United States Patent [19]

Foote

[11] Patent Number: 5,076,396

[45] Date of Patent: Dec. 31, 1991

[54] HYDRAULIC RAIL LUBRICATOR

[76] Inventor: John P. Foote, 2571 Morgan Rd., Marietta, Ga. 30066

[21] Appl. No.: 566,084

[22] Filed: Aug. 10, 1990

[51] Int. Cl.[5] ..... B61K 3/00

[52] U.S. Cl. ..... 184/3.1; 184/42; 417/229

[58] Field of Search ..... 184/2, 3.1, 3.2, 29, 184/39, 42; 104/279; 198/500; 417/229, 383, 385, 388

[56] References Cited

U.S. PATENT DOCUMENTS

| | | | |
|---|---|---|---|
| 2,237,312 | 4/1941 | Overmier et al. | 184/3.1 |
| 2,355,241 | 8/1944 | Rodman et al. | 184/3.1 |
| 2,401,303 | 6/1946 | Huber | 184/3.1 |
| 2,428,171 | 9/1947 | Mennie | 184/3.1 |
| 4,309,150 | 1/1982 | Payne | 417/229 |
| 4,334,596 | 6/1982 | Lounsberry, Jr. | 417/390 |

*Primary Examiner*—Ira S. Lazarus

*Assistant Examiner*—Alan B. Cariaso

*Attorney, Agent, or Firm*—Patrick F. Henry, Sr.

[57] ABSTRACT

A hydraulic master unit is mounted on the rail and has a master cylinder in which is mounted a plunger to be contacted by the wheel of the train. A master cylinder piston is driven against the compression of a cylinder spring inside the master cylinder body in which there is confined hydraulic fluid leading through a hydraulic line, through a hydraulic bulkhead assembly fitting and thence to a grease pump slave unit comprising a hydraulic grease pump piston operating against a grease pump spring inside of the grease pump housing in which there is a chamber confining the hydraulic fluid with the piston for operation to pump grease through the grease discharge and to draw grease from the grease container back into the slave cylinder and through a grease pump inlet valve against a grease pump inlet valve spring and so on in repetition in response to the contact of the master cylinder plunger by the train wheel.

4 Claims, 3 Drawing Sheets

HYDRAULIC RAIL LUBRICATOR

FIELD OF THE INVENTION

Train track lubricators employing grease containers from which grease is discharged by means of a hydraulic master unit contacted by the train wheel pumping grease from a hydraulic slave unit mounted inside the grease container and having valve means operable to discharge the grease.

BACKGROUND OF THE INVENTION

Railroad rail lubricators are well known for the purpose of applying grease to the inside flange of a railroad rail to reduce wear on both the rail and the wheels. One type of hydraulic rail lubricator disclosed in prior U.S. Pat. No. 4,334,596 employes gear pumps to discharge the lube. Other hydraulic systems are disclosed in U.S. Pat. Nos. 2,355,241 and 2,401,303; 2,349,259 and 2,428,171. Various differences and disadvantages exist in these prior systems such as the lack of simplicity of mechanical parts and the inherent cost of maintenance of the devices The problem includes getting a constant. supply of grease distributed onto the track without waste and with dependability each time the device is operated. The track lubricators available for use on the track, which, per se, do not form part of the present invention comprise electric, battery operated or solar powered devices which attach adjacent the track and are connected by conduits to the grease outlets. Such devices are sold by Portec Railway Products division, Box 38250, Pittsburgh, Pennsylvania, 15238-8250. Other devices are available on the market The present device can be used with existing track lubricators and easily mounts on the track for repeated operated by means of hydraulic fluid.

SUMMARY OF THE INVENTION

The present rail lubricator consists of 2 primary assemblies; the master cylinder assembly which attaches to the track and the grease pump assembly which can be submerged in the grease container. Master cylinder assembly is mounted to the outside or field side of the rail and is positioned so that a plunger protrudes slightly above the top of the rail. Internally, the master cylinder assembly consists of a plunger operated against a piston by force of a master cylinder spring which returns both piston and plunger to the top position after each stroke. The lower end of the master cylinder piston is a piston head which has slots on the side. These slots allow fluid to move into the hydraulic system or air to move out. The portion of the tube above the master cylinder is a fluid reservoir or chamber and can be refilled from the top side. As the wheel of a rail car passes over the plunger, it depresses the plunger and forces it into its cylinder which displaces hydraulic fluid through a hydraulic line, through a fitting on the hydraulic bulkhead and into the hydraulic slave cylinder. Pressure in the slave cylinder overcomes the grease pump spring and forces the grease piston into the grease cylinder. Grease in the cylinder, which is there from the previous stroke, first forces the inlet check valve closed and then is displaced out through the grease discharge check valve. This grease is then carried by a conduit hose to grease applicators on the rail. After the rail wheel has passed over the plunger, the grease piston returns to its original position due to the spring force and in doing so draws a fresh charge of grease to the grease cylinder and the hydraulic end of the piston returns the hydraulic fluid back to the master cylinder. As the grease piston returns so does the master cylinder piston and in doing so refills the master cylinder with hydraulic fluid and positions the plunger above the track ready for the next wheel to depress it.

Other and further objects and advantages of the present invention will become apparent upon reading the following description of a preferred embodiment taken in conjunction with the accompanying drawings.

A BRIEF DESCRIPTION OF THE DRAWINGS

DESCRIPTION OF A PREFERRED EMBODIMENT

Figure 1:
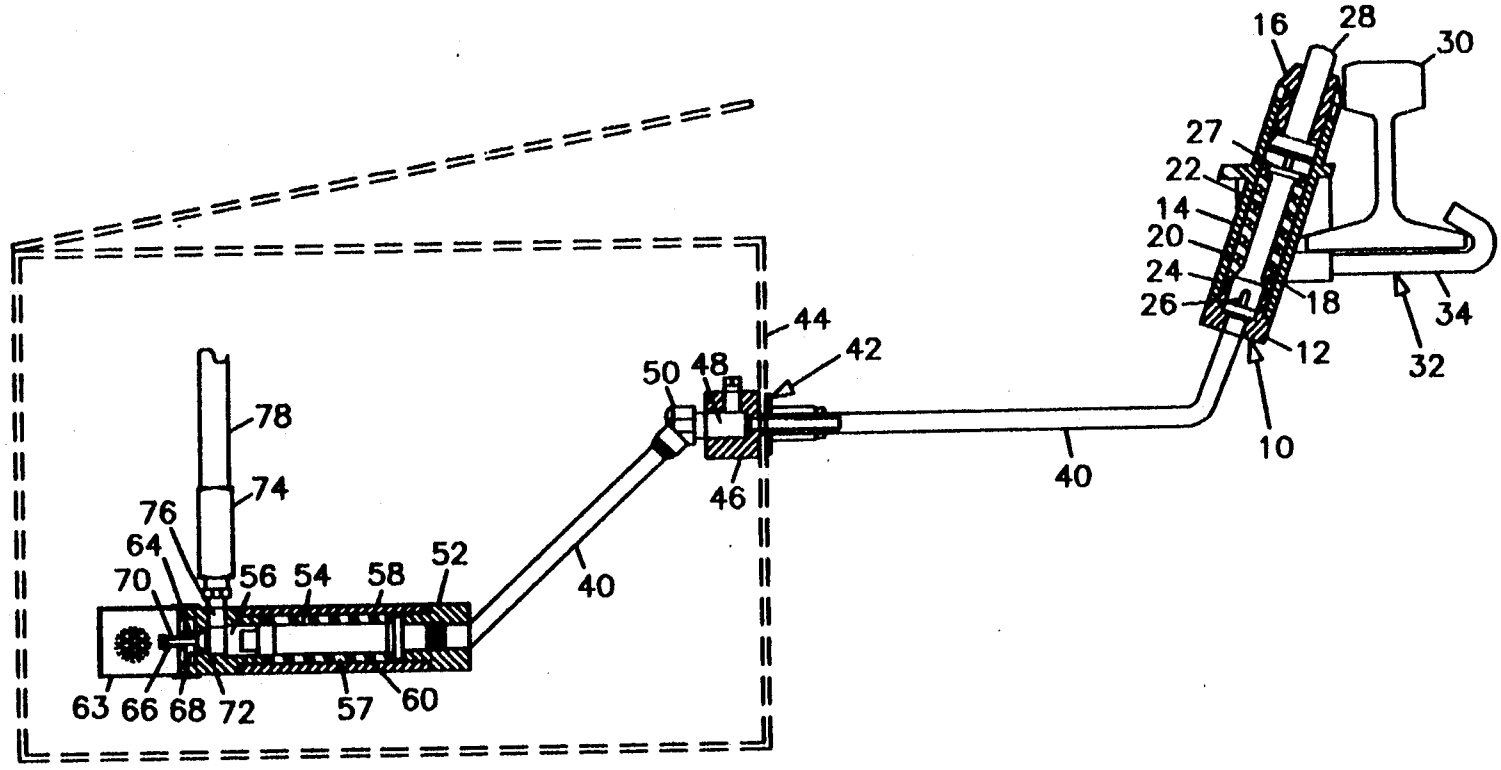
FIG. 1 is a side elevation view of the entire system mounted on a track and with portions thereof broken away to show internal details.
Figure 2:
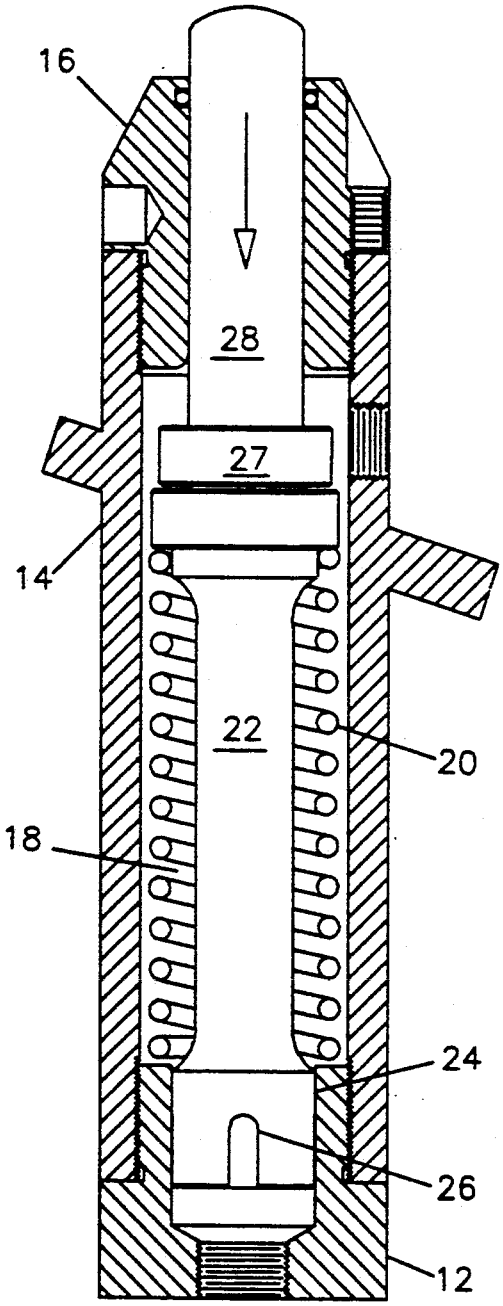
FIG. 2 is an enlarged view of the master cylinder unit in logitudinal cross-section showing the piston in low position.
Figure 3:
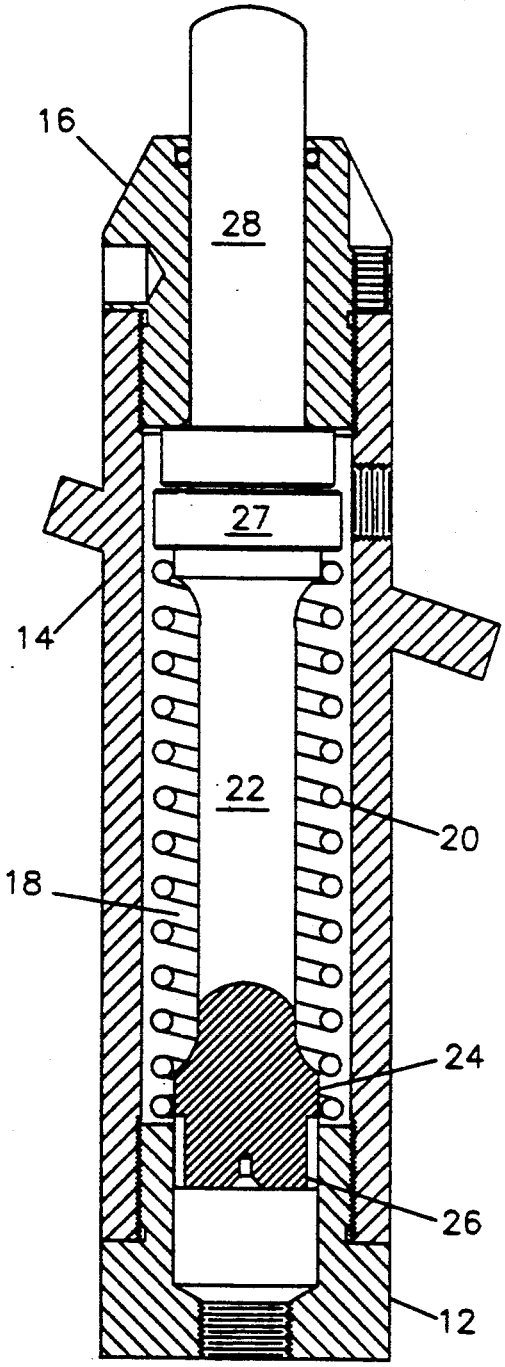
FIG. 3 is an enlarged view of the master cylinder unit in logitudinal cross-section showing the piston in high position.
Figure 4:
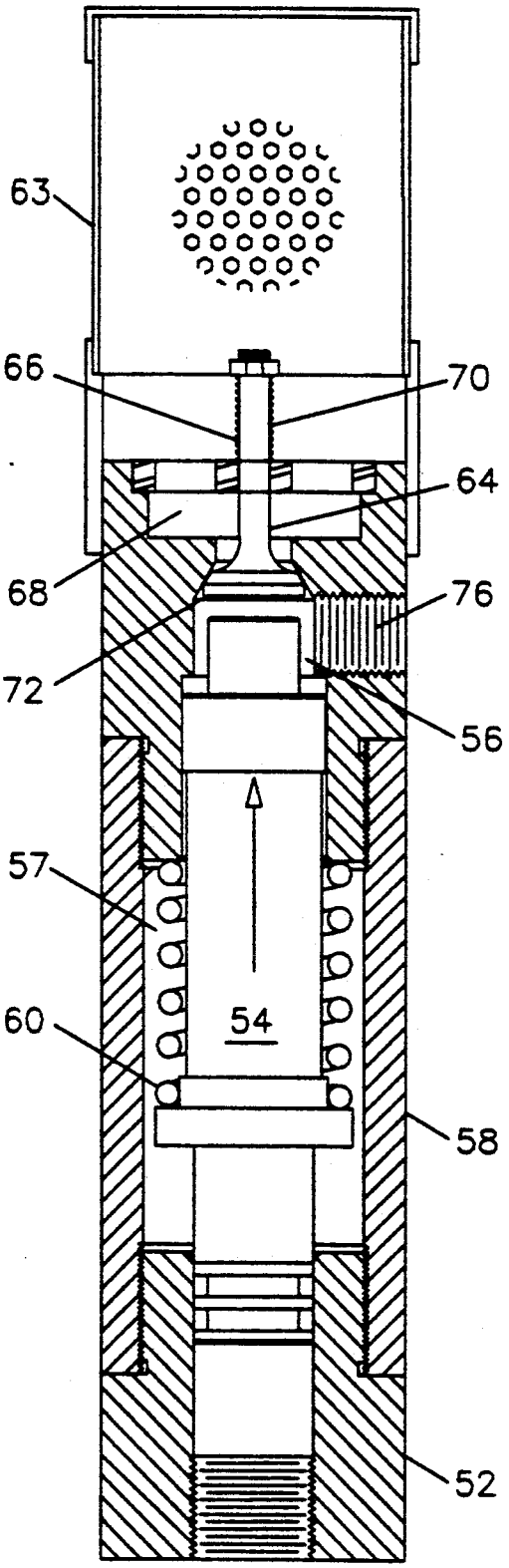
FIG. 4 is an enlarged view of the slave cylinder unit in longitudinal cross-section and with the grease piston in extended position.
Figure 5:
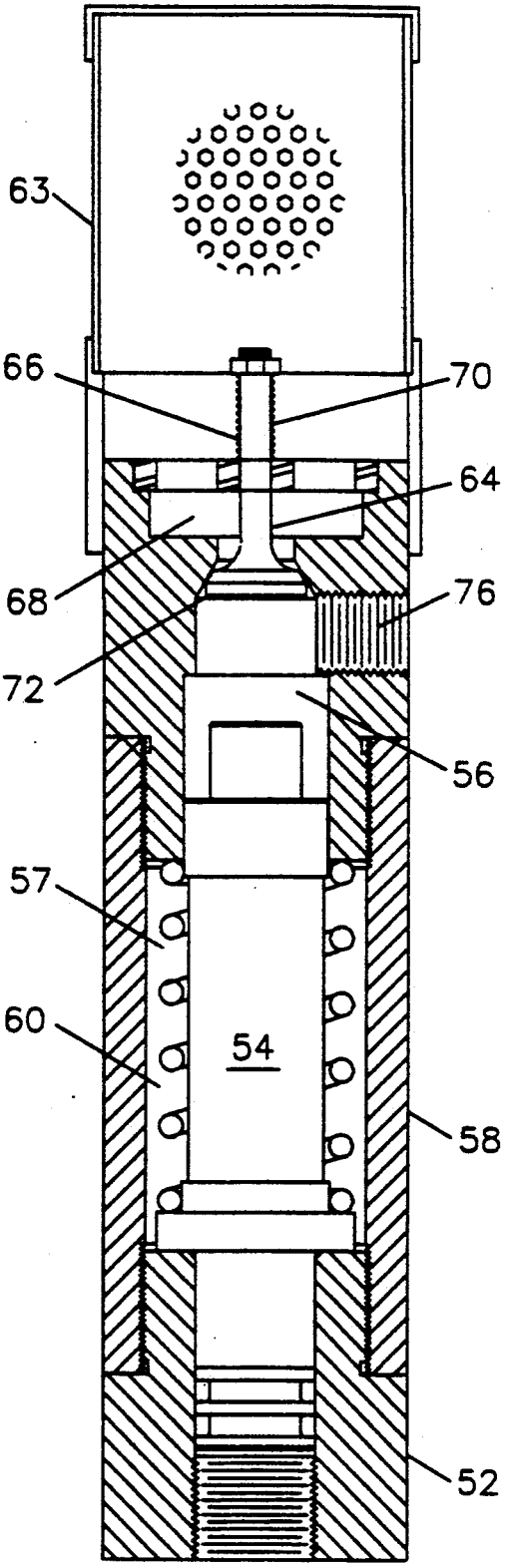
FIG. 5 is an enlarged view of the slave cylinder unit in longitudinal cross-section and with the grease piston in retracted position.

The hydraulic system 10 comprises a master cylinder 12 having a cylindrical housing 14 provided with a removable master cylinder cap 16. A chamber 18 inside the cylinder housing 14 normally is filled with hydraulic fluid and confines a coil spring 20 in which is located the master cylinder piston 22 which has a cylindrical bottom 24 in which are located enlongated notches 26. The top 27 of piston 22 is contacted by a master cylinder actuating plunger 28 which protrudes from the top of the master cylinder cap 16 so that it can be contacted by the wheel of a train travelling a track on which the entire master cylinder 12 is mounted by means of a bracket 32 having an attaching arm 34 attached to mounting plates on the outside of the cylinder housing 14.

With the piston 22 in the topmost position the slots 26 are slightly above the top of the cylinder 12 and allow makeup hydraulic fluid from chamber 18 to move into or out of the hydraulic system cylnder 12 or air to move out to make up for volume changes due to fluid loss or temperature variation. The bottom of one end of the hydraulic cylinder 12 is attached to a hydraulic line or tube 40 which is connected so as to be fluid tight in communication with the fluid reservoir in chamber 18 which can be filled from the top side. As the wheel of a rail car rolling along the track 30 passes over the plunger 28 it depresses plunger 28 and forces the master cylinder piston 22 down into its cylinder 12 thereby displacing hydraulic fluid through the hydraulic line 40. As piston 22 is forced down into cylinder 12 the first fluid displaced is forced up through slots 26 into chamber 18. As piston 22 continues to move into cylinder 12 the slots 26 pass below the top of cylinder 12 and cut off flow through slots 26, at this point all displacement of fluid is directed through tube 40 and on to hydraulic slave cylinder 52.

The hydraulic power fluid moves through the hydraulic line 40 and through a fitting 42 mounted on a grease container 44 to which is attached a hydraulic bulkhead assembly 46 mounted on the grease container 44. Fitting 42 comprises a connector 45 for attaching hydraulic line 40 in a fluid tight connection to a block 46 having chamber 48 therein to which is mounted and attached in fluid tight relationship a angle connector 50 having the hydraulic line 40 connected thereto and also in fluid tight relationship to the end of a grease pump slave cylinder 52 having a hydraulic grease pump piston 54 mounted for movement within the chamber 57 defined inside of the cylindrical body 58 of the grease pump slave cylinder 52. A large coil spring 60 surrounds the grease pump piston 54 inside the chamber 51. A longitudinal, axial passageway 68 communicates with a grease pump filter 63 through which grease is drawn from the grease container 44. A grease pump inlet valve V is provided with a valve member 66 in the valve opening 68 in which there is located a grease pump inlet valve spring 70. Valve member 66 has a head 72 which closes the opening 68 whenever the grease is pumped through a grease discharge check valve 74 which leads from an opening 76 in communication with the bottom or end of pump piston 54. Pressure in the hydraulic cylinder chamber 52 overcomes the grease pump spring 60 and forces the grease pump piston 54 into the grease cylinder. Grease in the chamber 56, there from the previous stroke, first forces the inlet check valve 64 closed and then is displaced out through the grease discharge check valve 74. This grease is then carried by the hose 78 to the individual grease applicators (not shown) which are located on the inside of the rail 30 so positioned as to apply grease to the inside flange of the rail. The grease applicators may be purchased on the open market and do not, per se, form a part of this invention and a possible source has been mentioned previously.

After the railway car wheel has passed over the plunger 28, the grease piston 54 returns to its original position due to spring force of spring 60 and in doing so draws in a fresh charge of grease through the filter 63, through the grease pump inlet valve 64 and the hydraulic end of the grease piston 54 returns the hydraulic fluid back to the master cylinder 12. As the grease piston 54 returns so does the master cylinder piston 22 and in doing so refills the master cylinder chamber 12 with hydraulic fluid and positions the plunger 28 above the track 30 ready for the next wheel to depress it.

While there is shown and described a preferred embodiment of this invention, this is for illustration and does not constitute any limitation on the scope of the invention as defined and by a proper interpretation of the appended claims.

The claims are as follows:

What is claimed is:

1. In a rail lubricator operated by contact with a rail wheel of a moving train:

a master hydraulic unit mounted on the rail to be contacted by the train wheel and being so positioned for such contact, a master unit plunger mounted for movement on said master unit in response to contact by said rail wheel, a master piston mounted for movement, a hydraulic chamber defined within said master unit and said piston being operated in said chamber by said plunger, outlet means on said master unit in communication with said chamber to control and admit hydraulic fluid from said chamber, means on said master unit for returning said plunger to normal position out of contact with said rail wheel and to return said plunger to pumping position, a hydraulic line in fluid tight communication with said chamber, a slave unit mounted to receive grease therein, a slave piston mounted on said slave unit, means on said slave unit for returning said slave piston to initial position after the hydraulic pressure is relieved by said master piston, valve means including a valve opening leading from said grease supply, grease discharge valve means leading from said slave cylinder and including a discharge opening through which grease is discharged from said grease inlet whereby grease drawn into said slave unit is discharged through said grease discharge valve in response to the operation of said master hydraulic unit, said master hydraulic unit includes a coil spring, said master piston being subject to said coil spring, and a master cylinder valve means located in communication with said chamber and said hydraulic line,

2. The device in claim 1 wherein said master piston comprises an end for pumping hydraulic fluid, said end having the slot therein, said piston end comprising pressing hydraulic fluid from said slot into said hydraulic line.

3. The device in claim 2, including: more than one slot in said master piston.

4. The device in claim 3, wherein: said chamber having a chamber bottom in which the end of said master piston operates to close said bottom and the slot in said master piston, and said bottom being in communication with the hydraulic line whereby fluid is forced into said line.

* * * * *